US005181406A

United States Patent [19]

Wolter

[11] Patent Number: 5,181,406

[45] Date of Patent: Jan. 26, 1993

[54] LOCKING DEVICE CONSISTING OF KEY AND LOCKING CYLINDER

[76] Inventor: Heinz Wolter, Meiswinkel 3, 5067 Kürten, Fed. Rep. of Germany

[21] Appl. No.: 724,979

[22] Filed: Jun. 28, 1991

[30] Foreign Application Priority Data

Aug. 25, 1990 [DE] Fed. Rep. of Germany ... 9012267[U]

[51] Int. Cl.[5] ..... E05B 9/08; E05B 35/08

[52] U.S. Cl. ..... 70/337; 70/370; 70/373; 70/375; 70/389; 70/406; 70/492; 70/DIG. 30

[58] Field of Search ..... 70/337, 340, 370, 373, 70/375, 382, 389, 390, 405–407, 492, 495, DIG. 30, DIG. 62, DIG. 71; 200/43.08, 330

[56] References Cited

U.S. PATENT DOCUMENTS

| | | | |
|---|---|---|---|
| 1,830,265 | 11/1931 | Fairchild | 200/43.08 X |
| 2,065,294 | 12/1936 | Simon | 70/406 |
| 2,301,531 | 11/1942 | Falk | 70/406 |
| 3,418,833 | 12/1968 | Kerr | 70/389 |
| 3,702,550 | 11/1972 | Shimizu | 70/389 X |
| 3,824,817 | 7/1974 | Orr | 70/DIG. 62 X |
| 4,075,879 | 2/1978 | Christopher | 70/492 X |
| 4,474,042 | 10/1984 | Patriquin | 70/492 X |

FOREIGN PATENT DOCUMENTS

| | | | |
|---|---|---|---|
| 0815793 | 6/1969 | Canada | 70/492 |
| 1149783 | 6/1963 | Fed. Rep. of Germany | 200/43.08 |
| 2617798 | 11/1976 | Fed. Rep. of Germany . | |
| 2856006 | 7/1980 | Fed. Rep. of Germany . | |
| 0255045 | 1/1949 | Switzerland | 70/492 |
| 639171 | 6/1950 | United Kingdom | 70/389 |

*Primary Examiner*—Lloyd A. Gall
*Attorney, Agent, or Firm*—Martin A. Farber

[57] ABSTRACT

A locking device consisting of key (2) and locking cylinder (1), in particular for the actuation of electric microswitches on keyboards, telephone or the like, has a locking cylinder housing (5) and a cylinder core (11) arranged for rotation in the bore thereof and cooperating with tumblers (16). The key (2), which has a stepped-down key shaft (35) is insertable into the cylinder core which has a head plate (12), coming after a specific rotation to rest against stops of the locking cylinder housing (5). In order to obtain a simplified construction with increased security and small structural length, there is a free space between the head plate (12) of the cylinder core (11) arranged on the front side of the locking cylinder (1) and the head end (14) of the locking cylinder housing (5). Into the free space the key-shaft shoulder (37) enters, and one or more stops of the locking cylinder housing (5), are arranged at different distances from an axis of rotation of the core. The stops protrude for limiting the possible angle of rotation of the cylinder core (11) by striking a radially correspondingly widely projecting shoulder (37) of the key-shaft.

11 Claims, 7 Drawing Sheets

LOCKING DEVICE CONSISTING OF KEY AND LOCKING CYLINDER

FIELD AND BACKGROUND OF THE INVENTION

The present invention relates to a locking device consisting of key and locking cylinder.

A locking device of this type is known from German OS 26 17 798 and is intended for use on diesel engines. The locking cylinder housing is strengthened on the head side into a cover cap covering the head plate of the cylinder core. The cap bottom thereof forms in the middle a passage opening for the insertion of a key. The passage opening extends over a range of angles of rotation and with its radially extending edges forms counter-stops which cooperate with a shoulder on the key shank. The construction of such a locking device is expensive from a production standpoint and accordingly increases the cost of production. Furthermore there is a large structural length in relation to the number of tumblers. In addition, the security value of such a locking device is less because of the unconcealed position of the stops.

A locking device, in particular for the actuation of electric microswitches on keyboards, telephones or the like, is furthermore known from German OS 2 856 006, in which an edge which lies at a different radius from the axis of rotation of the core is formed on the insertion end of the key shaft of every key by an additional notch. This edge controls an additional pin, is guided radially in the cylinder core, and the outward lying end of which, which extends beyond the cylinder core, enters into a groove in the locking cylinder housing which is open toward the cylinder core and the bottom surface of which consists of a plurality of partial sections arranged at different radial distances. They form stops which, depending on the key used, in combination with the stop pin limit the angle of rotation of the cylinder core. On the one hand, it has the disadvantage of being of expensive development. On the other hand, due to the additional pin arranged in front of the core pins, the length of the locking cylinder which can be used for variation of the locking is reduced.

SUMMARY OF THE INVENTION

The object of the present invention is so to develop a locking device of this type that, in addition to a simplified construction and increased security, a small structural length is possible without reducing the number of the tumblers.

As the result of the development of the invention, a locking device of this above-mentioned type is provided which, even with a short structural length, is characterized, on the one hand, by simplified construction and, on the other hand, by a large number of locking variations. The simplified construction results from the fact that no additional structural parts are required in order to obtain the different positions of angular rotation. The edges lying at different radii to the axis of rotation of the core are now within the region of the shoulder of the key shaft and form stop edges there. The key shaft can therefore be provided with corresponding locking depressions even over its entire length. Along with this, the complete length of the locking cylinder can also be used to house tumblers so that a large number of locking variations can be obtained in relation to the length of the locking cylinder. When the key is inserted, the stops on the head end of the locking cylinder housing which are arranged on the same cross sectional plane as the stop edge of the key serve to obtain different size ranges of angle of rotation. Said stops extend compactly between the head plate of the cylinder core arranged on the front side of the locking cylinder and the head end of the locking cylinder housing within a free space into which the shoulder of the key shank protrudes when the key is in inserted position.

It is possible to produce the stop edges by corresponding corner cutouts on the shoulder of the key shaft. Depending on the number of ranges of angular rotation, a corresponding number of keys with corner recesses cut to different depths are made. A suitable number of stops can also be provided on the head end of the locking cylinder housing. The use of a key with the largest possible corner recess permits the turning of the cylinder core through a large range of angular rotation while the key with the corner recess of minimum depth permits only a small turning movement of the cylinder core.

Instead of corner recesses, however, also other shapes can be produced on the shoulder of the key shaft which cooperate with correspondingly shaped stops of the locking cylinder housing. In all cases, however, the shoulder of the key shaft is used to obtain ranges of angular rotation of different size, namely in combination with corresponding stops. The tumblers can in this case be developed in the form of either pin tumblers or platelet tumblers. If the latter are used, then the provision of a larger number of tumblers is even made possible. Since the development in accordance with the invention dispenses with a separately controlled stop pin, the number of structural parts is reduced, as mentioned above, together with a reduced susceptibility to failure of the locking cylinder.

While in the aforementioned prior art the edges exercise a control function, they now fulfill exclusively a stop function, which can be made considerably less sensitive. A particularly short structural length is facilitated by the fact that the head end of the locking cylinder housing which forms the stops is arranged overlapping a front plate which is passed through by the shoulder of the key shaft. With the key inserted, the stop edges of the key, the stops and the front plate extend in a cross-sectional plane, so that the construction can be especially short in that region. This is further contributed to by the fact that the key shaft on its one narrow longitudinal edge forms the locking notches and its other, rear narrow longitudinal edge passes over into the shoulder of the key shaft. The locking notch adjacent to the shoulder of the key shaft can therefore be arranged close to the latter without material being taken away from the shoulder of the key shaft upon the cutting of the locking notches. The shoulder of the key shaft therefore is retained in its entirety. It can even be used also for the locking variation by providing at least one profiled longitudinal groove in that region. It is then possible to provide between a stop projection on the locking cylinder housing side and another one on the cylinder core head plate a limit stop superordinate to the stops.

After passing through the maximum range of angular rotation of the locking cylinder core, the stop projection on the locking cylinder housing side is acted on by the one on the cylinder core head plate, so that then both the corresponding stop edge of the key and the stop projection of the cylinder core come into play. On basis of the invention, different key withdrawal positions can also be realized. If a variation is to be created also in this case, then it is advisable that a non-spring-loaded additional pin for preventing the withdrawal in certain positions of rotation be associated with individual keys. This non-spring-loaded additional pin cooperates preferably with the broad surface at the tip of the key, for which purpose the latter forms an entrance depression. In the corresponding position of angular rotation, the locking cylinder housing must be provided with a recess facing the cylinder core. If this recess is missing, then the key in the corresponding position of angular rotation cannot be withdrawn. An exact alignment of the tumblers is assured by the fact that the key forms support sections on the tip of the key which extend parallel to the key insertion opening and in the narrow longitudinal edge region opposite the shoulder of the key shaft. This is particularly advantageous when a longitudinal profiling of the key shaft is dispensed with.

The shape of the platelet-like tumblers also contributes to a smaller structural length with greater security against unlocking. The width of the longitudinal ribs of the locking cylinder housing corresponds to that of the grooves in the wall of the electric microswitch housing. The window-shaped openings provided in axial alignment with the ribs serve for entrance of the ends of the platelet-shaped tumblers, the width of said ends being also adapted to the openings, ribs and grooves. Thus, corresponding tumblers, when the key is withdrawn, can be supported both on the locking cylinder housing and on the groove walls, so that in the event of an unauthorized attempt at opening the turning forces involved therein are conducted additionally into the microswitch housing. As a result of the favorable distribution of forces, the platelet-shaped tumblers are relieved, which permits the production of large blocking actions even with spatially small development. In other words, this means that the ends of the platelet-shaped tumblers lie in the shadow of the ribs and can therefore rest directly on the flanks of the grooves of the microswitch housing. Allowing the width of the lateral frame legs of the platelet-shaped tumblers to correspond approximately to the thickness of the material of the tumblers themselves also contributes to increased stability with small structural form. The frame legs are formed by the cutout in the platelet tumbler for the passage of the key shaft. Unintentional deformation of the platelets upon attempts at unlocking is therefore counteracted to a large extent.

It is advisable to provide four longitudinal ribs and window-shaped openings arranged at equal angles apart. The locking cylinder housing is therefore held extremely securely against turning in the microswitch housing. Also, in this way more than two key withdrawal positions can be produced. Basically, a key withdrawal position can be created if the longitudinal direction or direction of movement of the platelet-shaped tumblers coincides with the diameters passing through two opposite longitudinal ribs and window-shaped openings. It is possible so to position the stop positions that they are aligned with the position of angular rotation of the window-shaped openings. In this case, the number of withdrawal positions can be varied by the placement of a non-spring-loaded additional pin of the cylinder core. If the removal of the key shaft receiving the inner end of the additional pin is to be assured, then an entry recess for the outwardly pointing end of the additional pin must be provided at the level of the corresponding rib. If there is no corresponding recess at the level of a rib, then a stop position can be produced by the corresponding angle of rotation, to be sure, but the key nevertheless cannot be withdrawn.

BRIEF DESCRIPTION OF THE DRAWINGS

One embodiment of the invention will be explained below with reference to the drawings, in which.

DETAILED DESCRIPTION OF THE PREFERRED EMBODIMENTS

Figure 1:
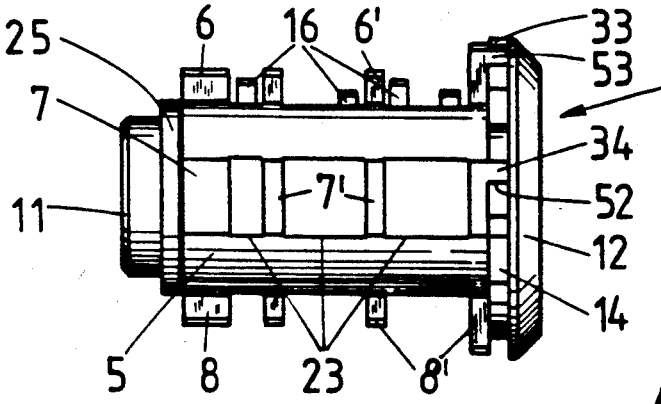
FIG. 1 is a longitudinal side view of a locking cylinder according to the invention, enlarged approximately four times.
Figure 2:
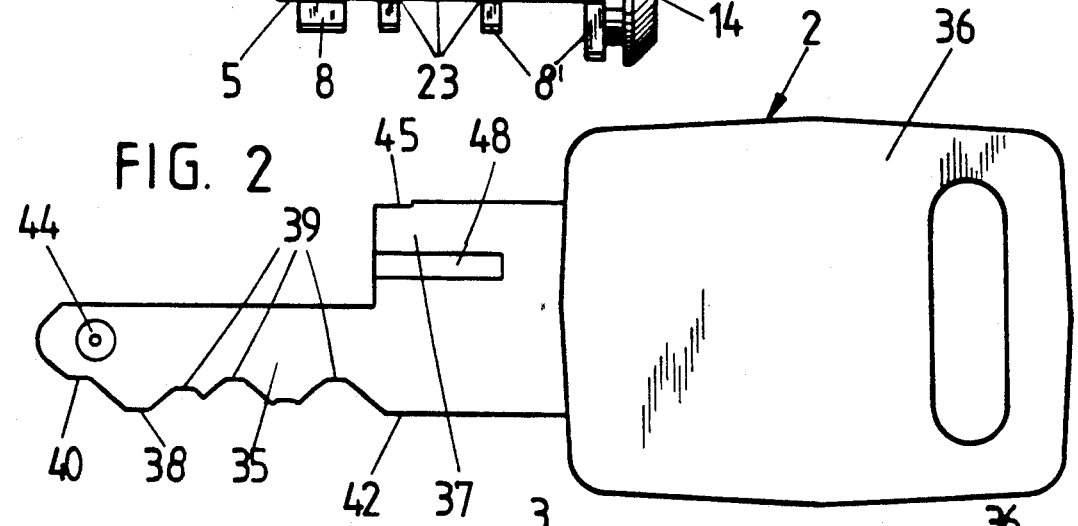
FIG. 2, is a side view of a first key thereof.
Figure 3:
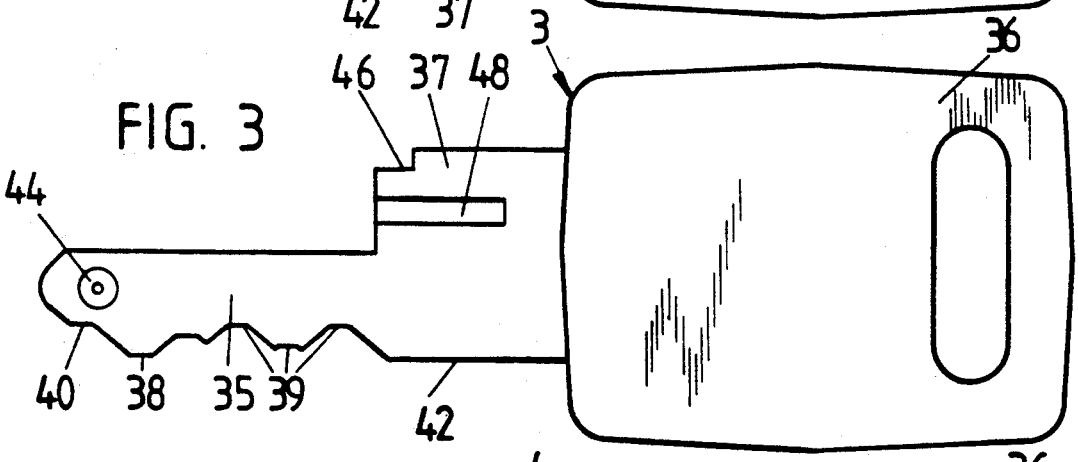
FIG. 3 is a side view of a corresponding second key.
Figure 4:
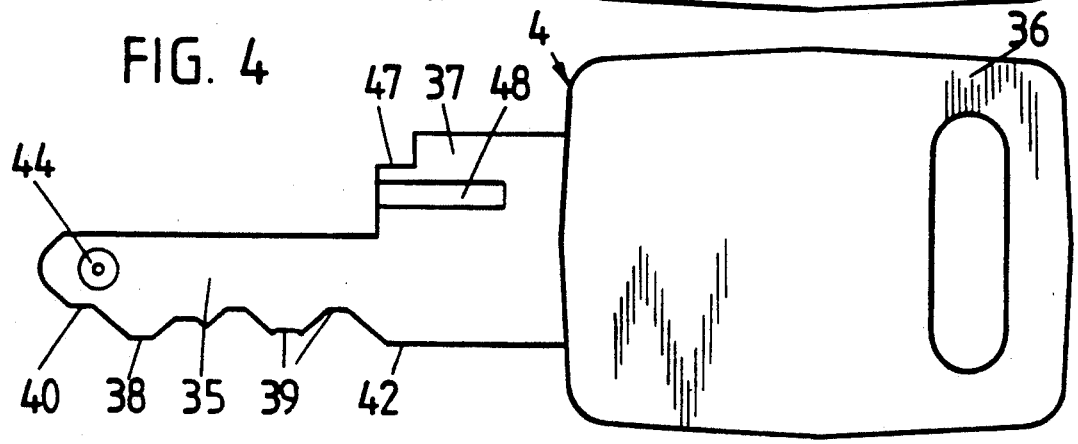
FIG. 4 is a side view of a third key.

The reference number 1 designates a locking cylinder which can be actuated by means of a first key 2, a second key 3 and a third key 4.

In detail, the locking cylinder 1 has a cylindrical locking cylinder housing 5 with longitudinal ribs 6, 7, 8, and 9 extending radially from it in the shape of a cross. A cylinder core 11 is mounted for rotation in a central bore 10 of the locking cylinder housing 5. The core passes at the key insertion end into a head plate 12 of larger diameter. This head plate is equipped on its rear side with a concentrically arranged recess 13 for the partial entrance of the head-side end 14 of the cylinder housing 5. In this way, the cylinder core 11 has an additional mounting. Furthermore, in this way an overlapping is produced between the cylinder housing 5 and the cylinder core 11.

Receiving chambers 15 for platelet tumblers 16 are provided, one behind the other, in the cylinder core 11. The receiving chambers 15 are developed in the form of diametral slots. From each receiving chamber 15 there extends a niche 17 which is wider than the width of the slots. The niche has the form of a blind hole and serves for the housing of a compression spring 18 which acts with its one end on a laterally projecting arm 19 of the platelet tumbler 16. The other end of the compression spring 18 is supported on the bottom 17' of the niche.

Figure 14:
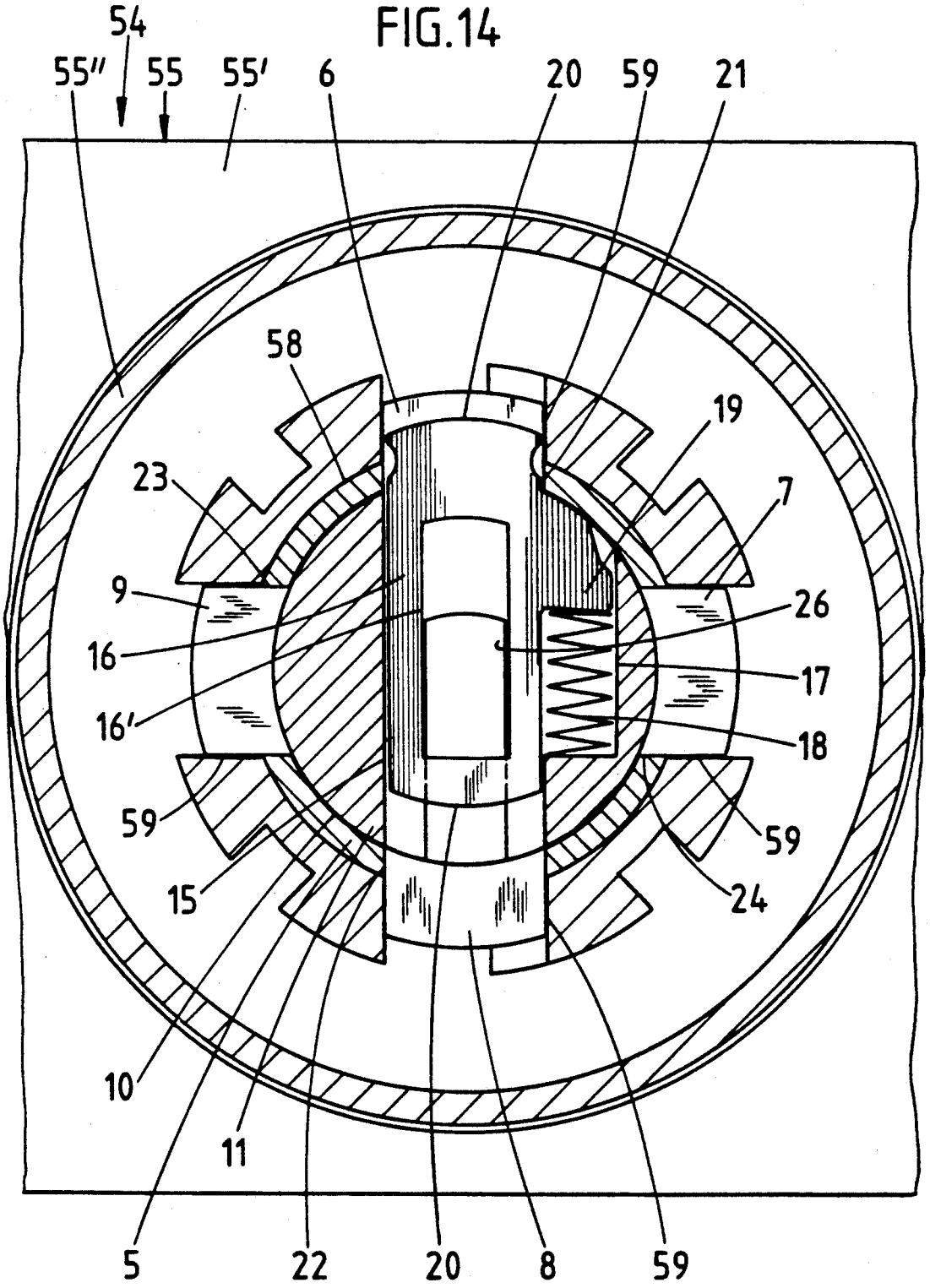
FIG. 14 is the section along line XIV—XIV in FIG. 12, enlarged approximately ten times.

When the key is not inserted, the arms 19 rest against the inner wall of the bore 10 and limit the displacement path of the platelet tumblers 16 in the blocking direction, as can be noted from FIG. 14. The opposite transverse edges 20 of the platelet tumblers 16 are at a distance from each other that corresponds to the diameter of the cylinder core 11. Furthermore, the transverse edges 20 are adapted to the rounding of the cylinder core 11.

In the withdrawal position of the key, the end regions of the platelet tumblers 16 which are adjacent the arms 19 enter into window-shaped openings 21 of the cylinder housing 5 that are aligned with them. The openings 21 extend at the height of the longitudinal rib 6. The width of the openings 21 corresponds to that of the longitudinal rib 6. Furthermore, the width of the longitudinal rib 6 and of the openings 21 is adapted to that of the platelet tumblers 16; see FIGS. 7 and 14. This means that, with the key withdrawn, as can be noted from FIG. 14, the end regions of the platelet tumblers 16 engage through the openings 21 and lie in the shadow of the longitudinal rib 6. Due to the window-shaped openings 21, the longitudinal rib 6 is so divided that transverse webs 6' remain, which see to it that there is sufficient stability of the cylinder housing 5.

Opposite the window-shaped openings 21, openings 22 are also provided in the cylinder housing 5 and penetrate the longitudinal rib 8. These openings 21 and 22 permit the platelet tumblers 16 to move back and forth upon the introduction of the key. Both ends of the platelet tumblers 16 are of the same width. This is true also of the window-shaped openings 21 as well as the longitudinal rib 8.

In the same cross-sectional planes as the window-shaped openings 21 and 22, further openings 23 and 24 are worked into the locking cylinder housing 5 in a cross-shaped arrangement, producing a plurality of key withdrawal positions. The window-shaped openings 22, 23 and 24 also leave stabilizing webs 7', 8' and 9' which are formed by corresponding sections of the longitudinal ribs 7, 8 and 9. The width of the window-shaped openings 23 and 24 as well as of the longitudinal ribs 7 and 9 is adapted to those of the longitudinal ribs 6 and 8.

Figure 6:
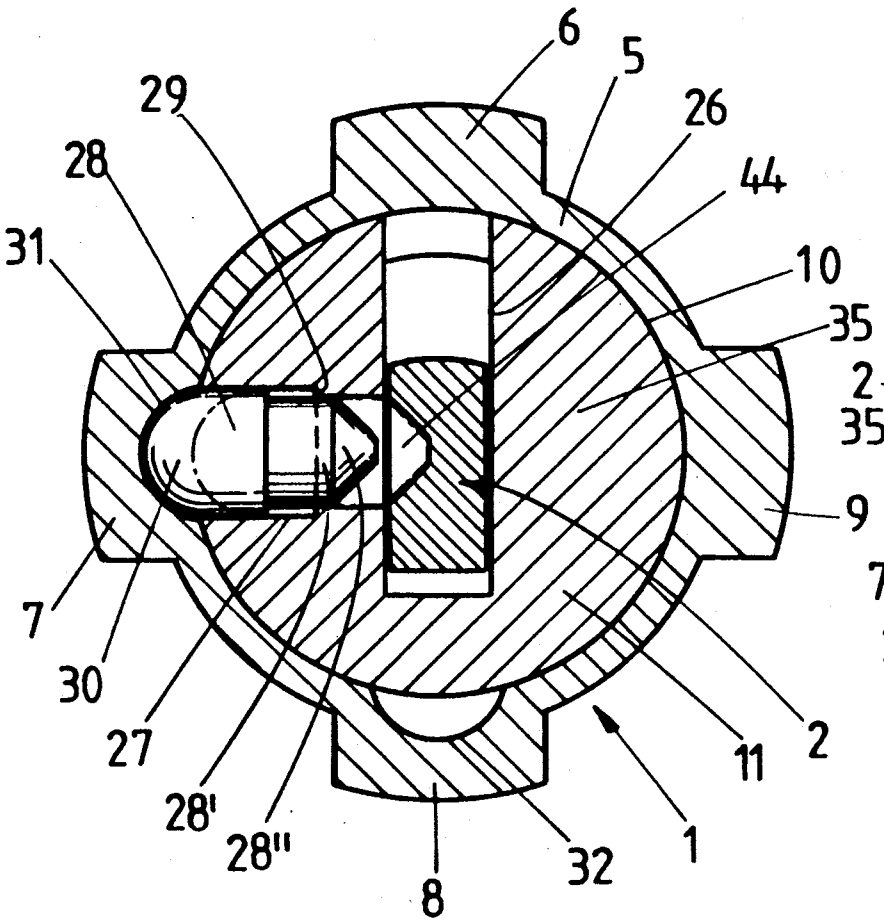
FIG. 6 is a section along the line VI—VI in FIG. 5.
Figure 9:
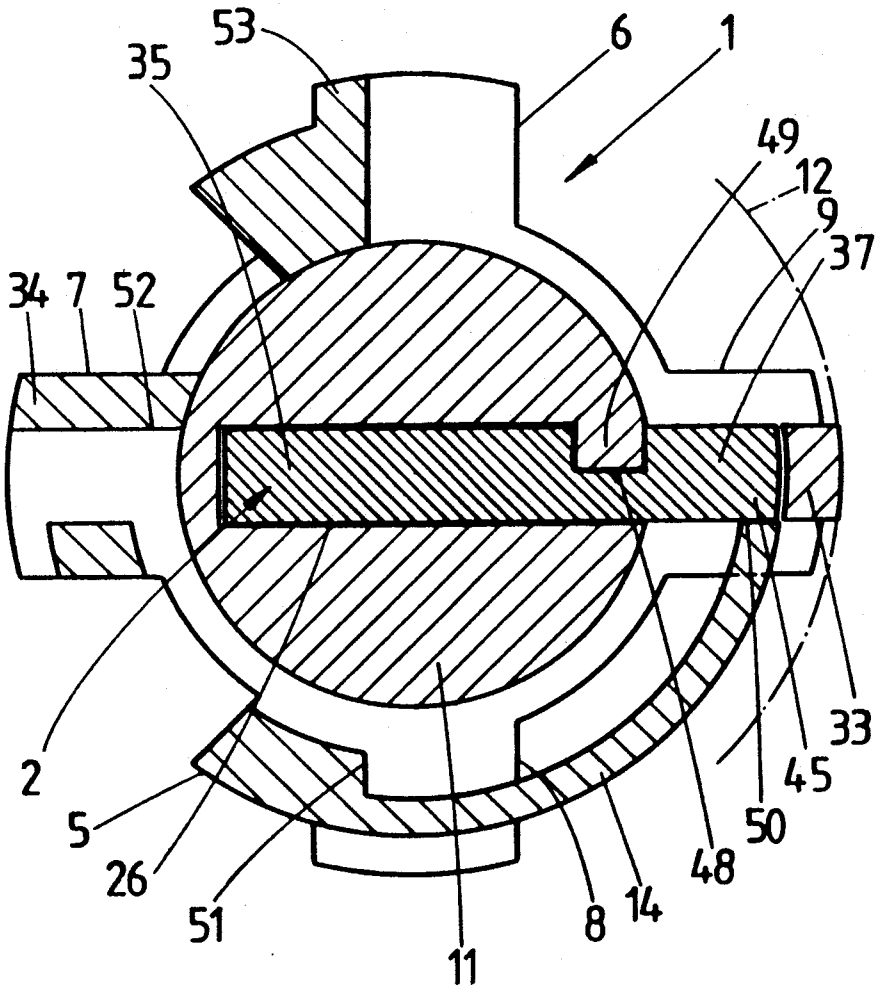
FIG. 9 is a section corresponding to FIG. 8, but with the cylinder core rotated with the first key by 90° into the stop position.

In axial direction, the cylinder core 11 is secured in the locking cylinder housing on one end by the head plate 12. The cylinder core 11 is secured in the other direction by a spring washer 25 which rests against the face side of the locking cylinder housing 5 that faces it. Between the spring washer 25 and the adjacent platelet tumbler 16, in a stepped bore 27 which is aligned transverse to a longitudinally extending key channel 26 of the cylinder core 11, there is guided a non-spring-loaded additional pin 28. Its steppeddown end 28' passes into a truncated cone 28'' and can enter into the key channel 26. Its entrance is limited by the shoulder 29 of the stepped bore 27. The other end 30 of larger cross section of the additional pin 28 ends in a ball shape and enters, as shown in FIG. 6, in formfitting manner into a recess 31 at the level of the longitudinal rib 7 of the locking cylinder housing 5. An additional recess 32 is then also provided at the level of the longitudinal rib 8. This means that the locking cylinder 1 has two key withdrawal positions.

Figure 8:
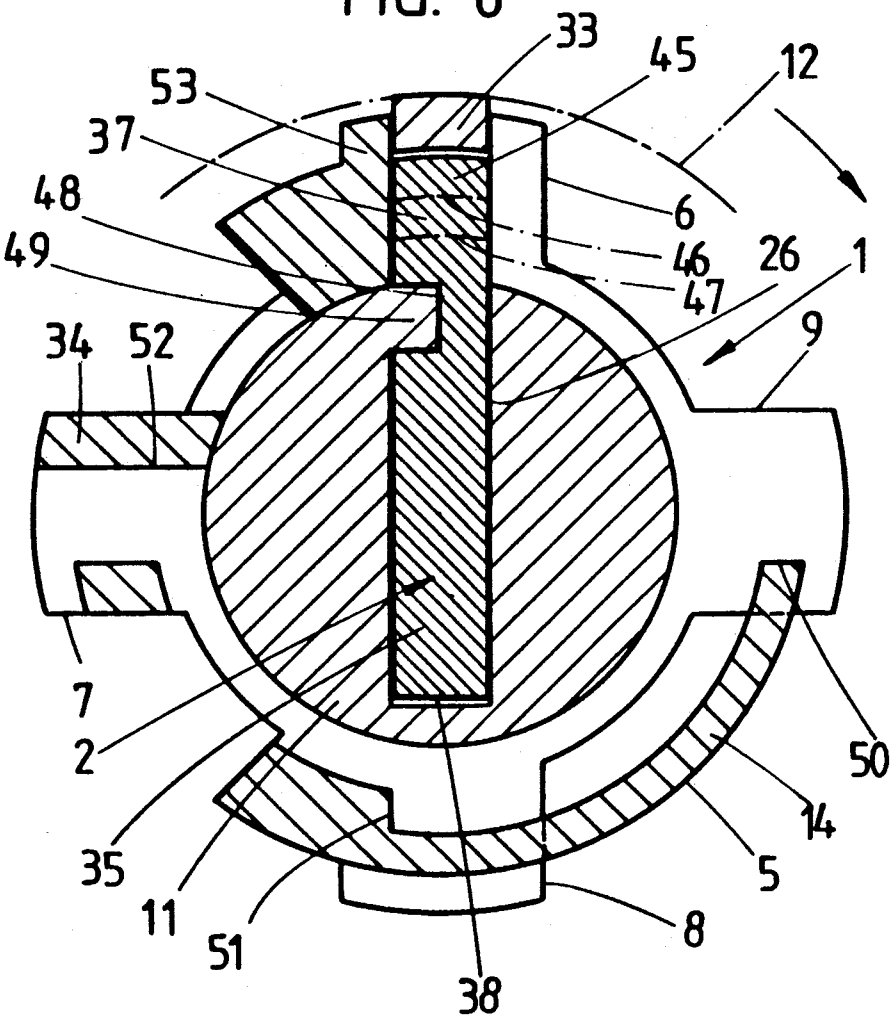
FIG. 8 is a section along the line VIII—VIII in FIG. 5.
Figure 11:
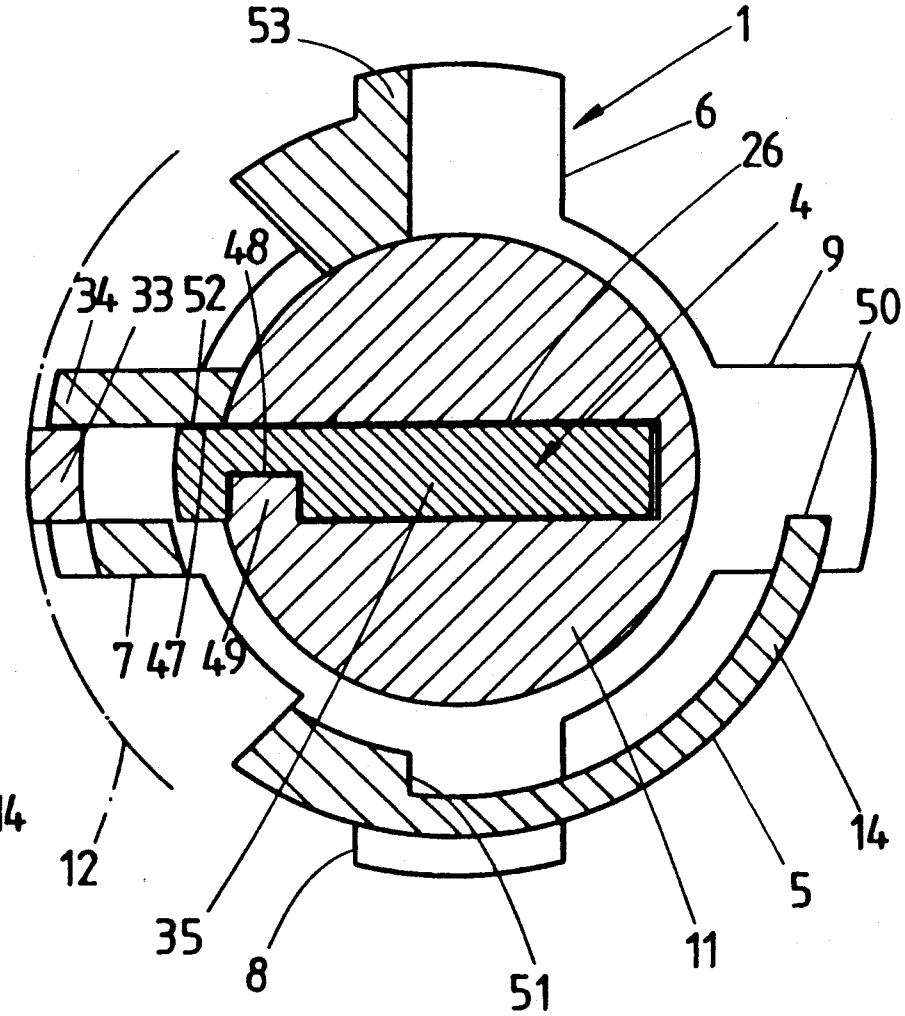
FIG. 11 is the corresponding section with inserted third key, the cylinder core being turned 270° into the stop position.
Figure 10:
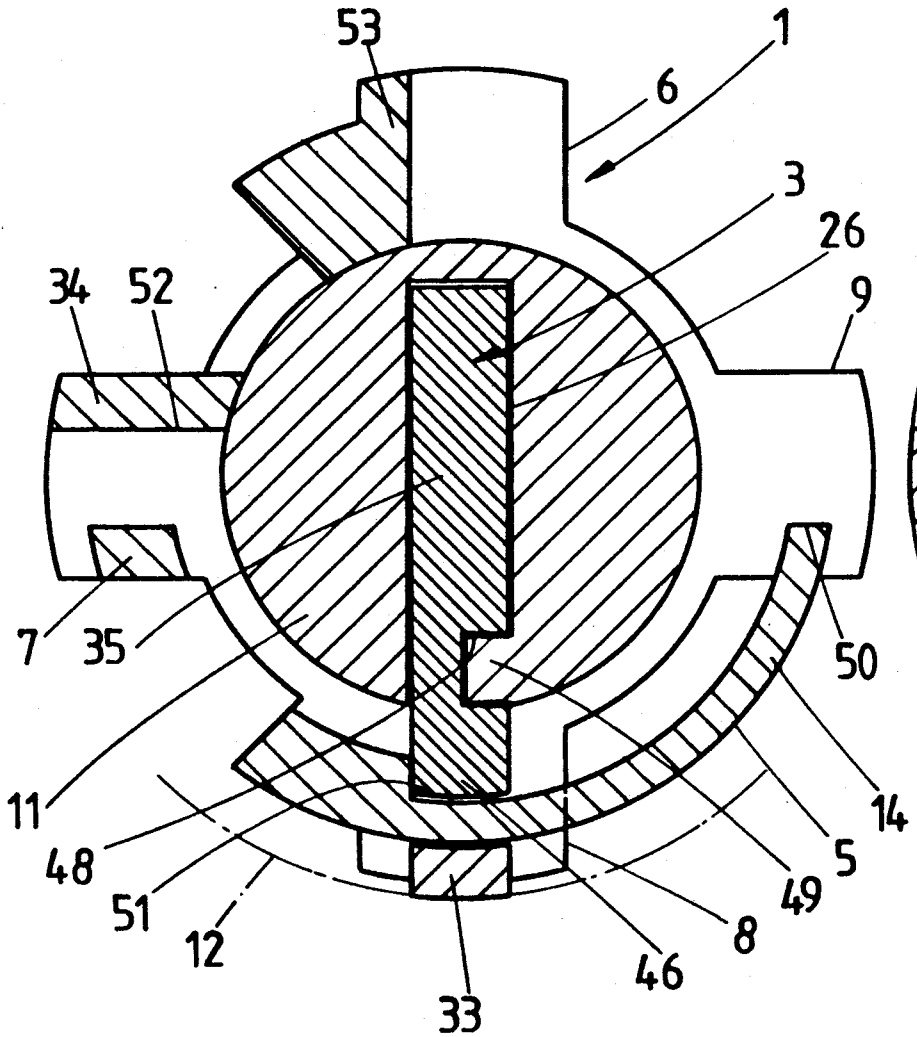
FIG. 10 is also a section corresponding to FIG. 8, in which the cylinder core is being rotated 180° by the inserted second key into the stop position.
Figure 12:
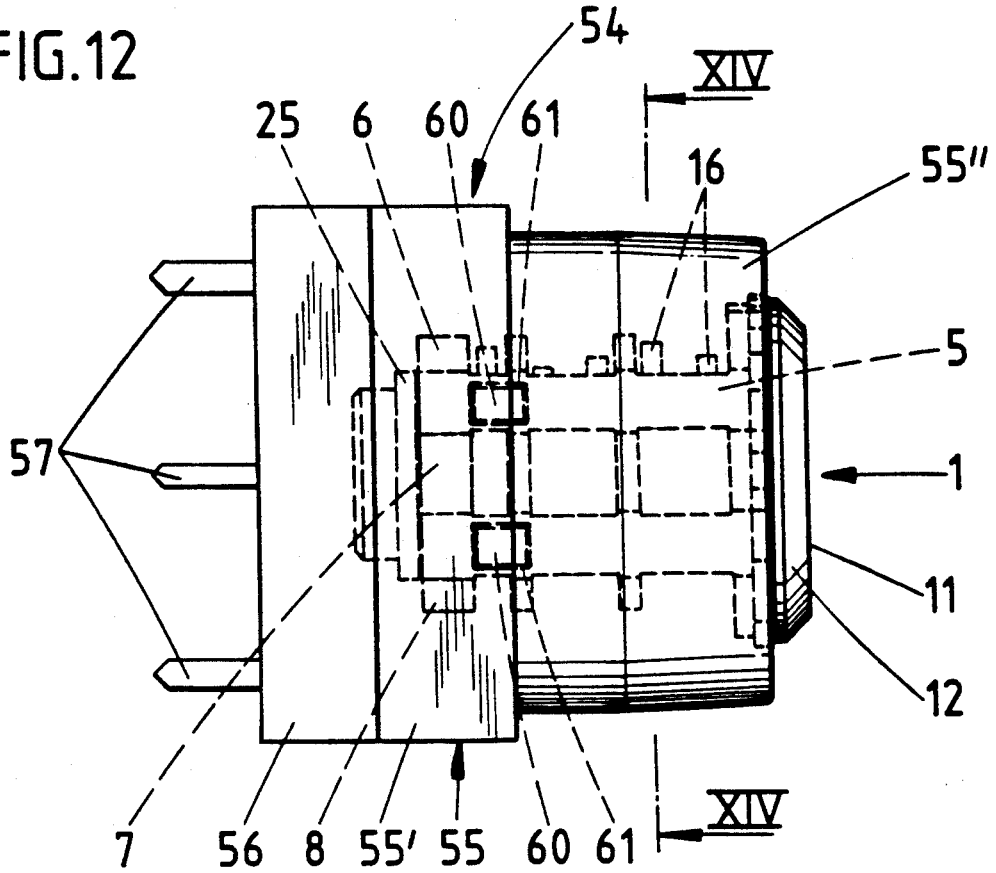
FIG. 12 is a side view of the electric microswitch which receives the locking cylinder, enlarged approximately four times.
Figure 13:
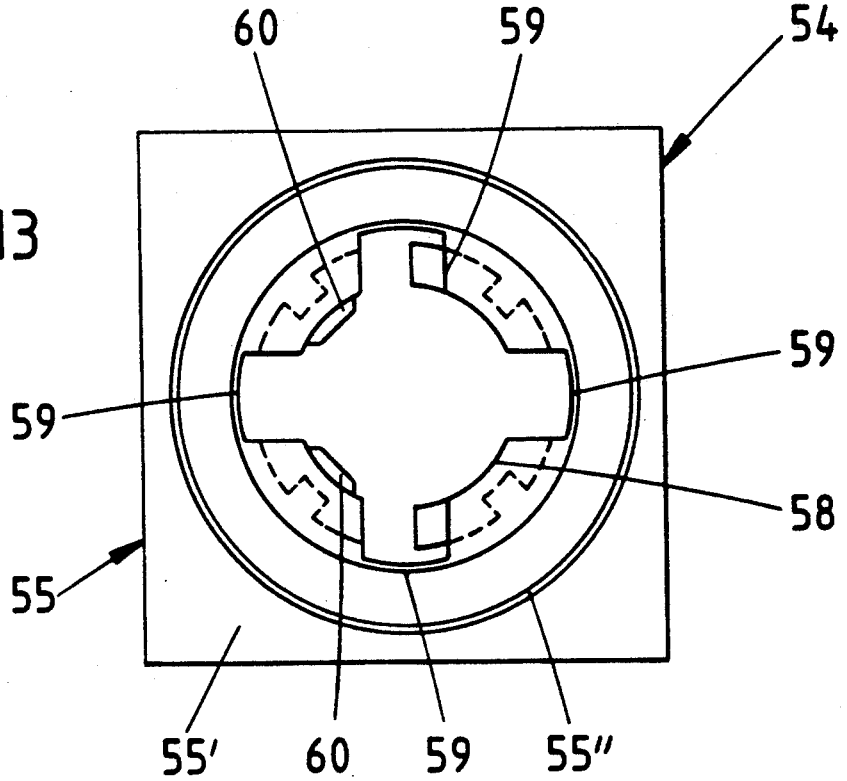
FIG. 13 is an end view of the microswitch housing, seen the insertion side.

The key channel 26 is a longitudinal slot which is arranged eccentric to the cylinder core 11 and extends through the cylinder core 11. The width of the slot of the key channel 26 is reduced at the head plate 12. There extends from the rear side of the head plate 12 a stop projection 33 which cooperates with a stop projection 34 on the locking cylinder housing side. The latter projection is at the level of the longitudinal rib 7 on the head-side end 14 of the locking-cylinder housing 5. This means that the cylinder core 11 must be turned 270°, starting from its initial position according to FIG. 8, until the limit stop is reached.

Figure 5:
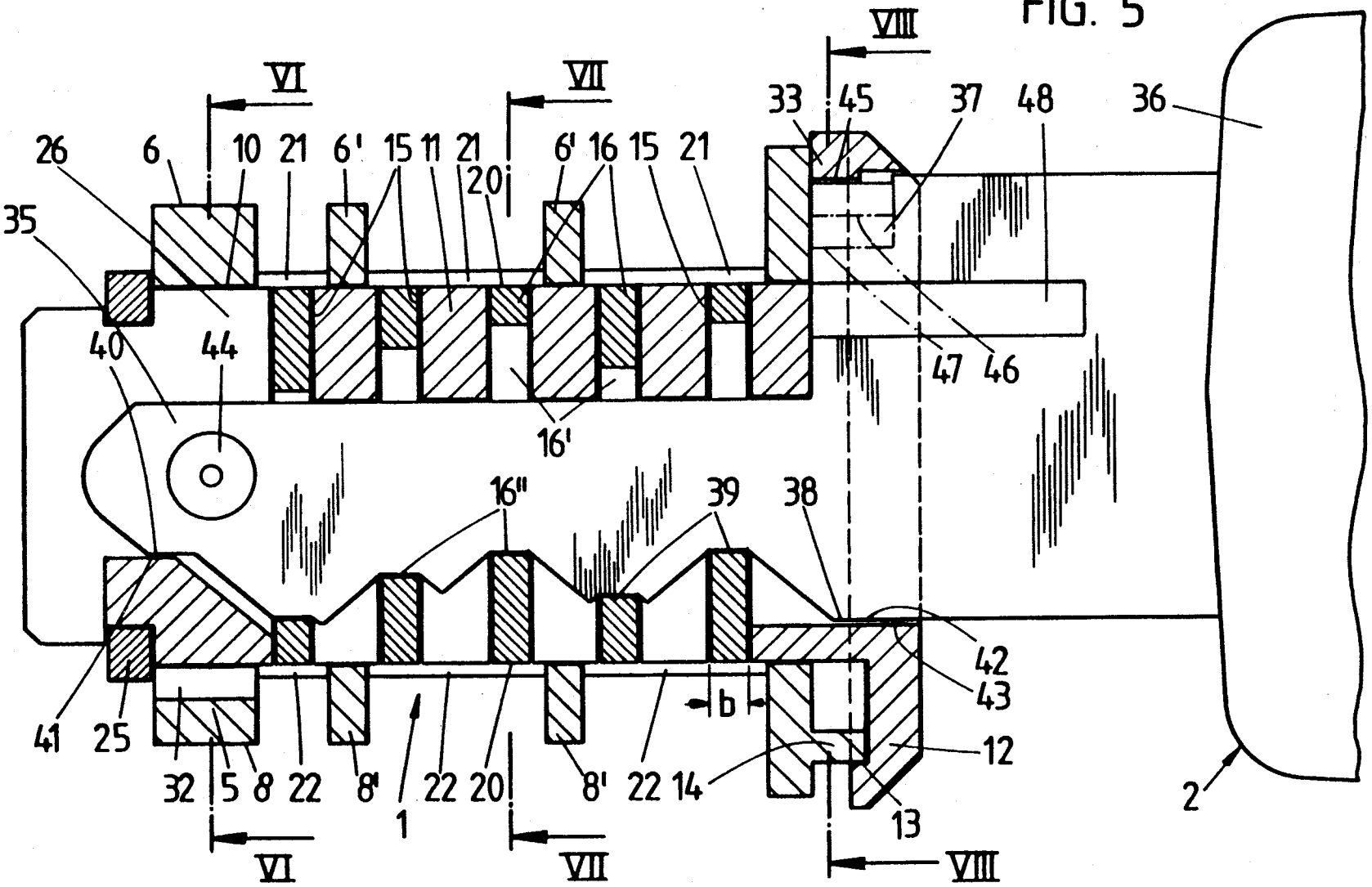
FIG. 5 is a longitudinal section, enlarged approximately ten times, through the locking cylinder with the first key inserted.
Figure 7:
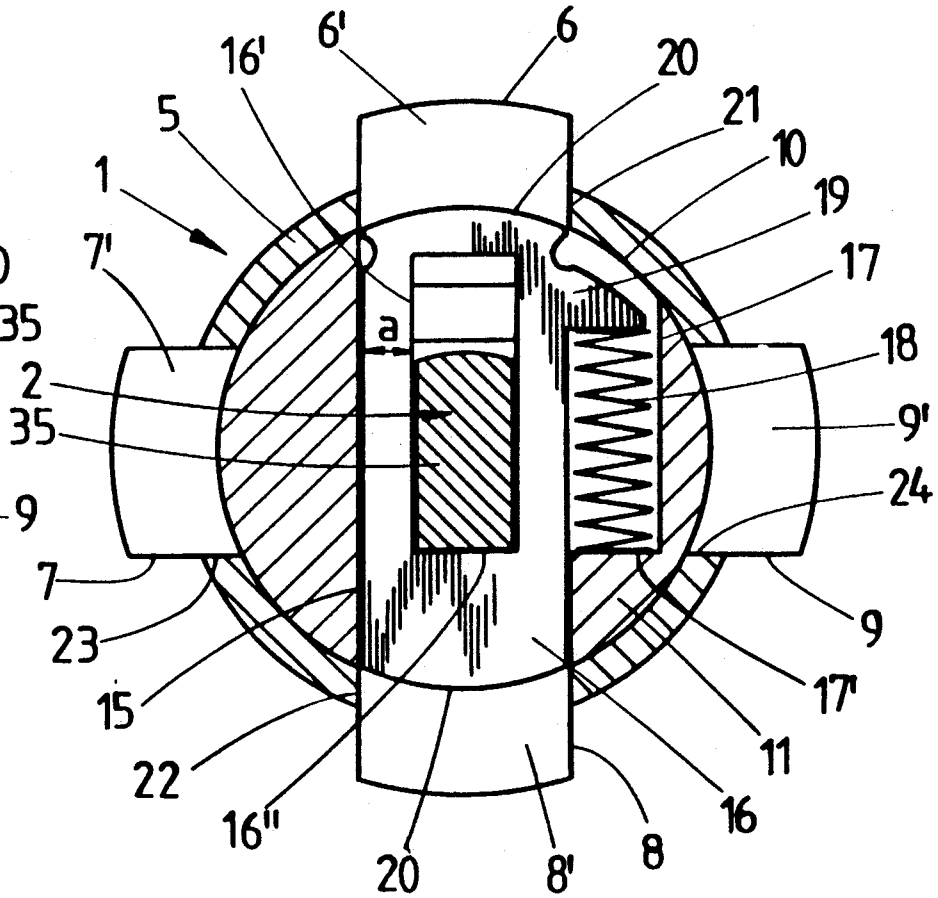
FIG. 7 is a section along the line VII—VII in FIG. 5.

By comparison of FIGS. 5, 7 and 14 it can be noted that the width a of the lateral frame arms, formed by the window 16' in the platelet-shaped tumblers 16, corresponds approximately to the thickness a of the material of the tumblers. In this way, the platelet-shaped tumblers are imparted sufficient stability to prevent to a large extent unauthorized twisting of the cylinder core 11 without lining up the platelet tumblers 16.

The three keys 2, 3 and 4 are substantially identically shaped. Every key 2, 3 and 4 comprises a key shaft 35 and a key handle 36. Between the key shaft 35 and the key handle 36 the key shaft forms, as the result of a stepping down, a key-shaft shoulder 37. On the narrow longitudinal edge 38 lying opposite said shoulder, locking notches 39 with which the platelet tumblers 16 can be properly aligned are cut out. The narrow longitudinal edge 38 passes at the insertion end of the key shaft into a supporting section 40 which, when the key is in inserted position, rests on a transverse flank 41 of the key channel 26. The narrow longitudinal edge-region opposite the key-shaft shoulder 37 also forms a supporting section 42 which cooperates with a transverse flank 43, arranged at the same height, of the key channel 26; see, in particular, FIG. 5.

At the level of the additional pin 28 each key forms on its key shaft 35 an entrance depression 44 for the frustoconical end 28'' of the additional pin 28.

The keys 2, 3 and 4 differ by the fact that in the region of the key-shaft shoulder 37 there are provided stop edges 45, 46 and 47 which are cut in to different depths and extend parallel to the direction of insertion and parallel to the axis of rotation of the cylinder core. The stop edge 45 of the first key 2 is at the greatest distance from the axis of rotation of the cylinder core while the stop edge 47 of the third key 4 is closest to the cylinder core axis.

The key-shaft shoulder 37 is also used to form a profiled longitudinal groove 48 for the entrance of a longitudinal rib 49 on the cylinder-core side which protrudes into the key channel 26.

The above-mentioned stop edges 45, 46 and 47 cooperate with differently arranged stops 50, 51 and 52 on the head end of the locking cylinder housing 5. These stops are at different distances from the cylinder core axis in such a manner that the distance of the stop 52 is the smallest. In the initial position, a projection 53 of the head end 14 of the locking cylinder housing 5 which is adjacent to the key channel 26 acts on the stop projection 33 of the cylinder core 11, see FIG. 8.

Between the head plate 12 of the cylinder core 11 and the head end 14 of the locking cylinder housing 5 there remains a free space due to the stops 50, 51 and 52, into which free space the key-shaft shoulder 37 enters; see FIGS. 5, 8, 9, 10 and 11.

An electric microswitch 54 serves to receive the locking cylinder 1. It contains a microswitch housing 55 with attached switch plate 56 in which the switch elements (not shown) are housed and from which corresponding connection contacts 57 extend. The switch plate 56 is of square contour. It is, on its part, connected to a section 55' of the microswitch housing 55, which section 55' is adapted in its contour to that of the switch plate 56. In axial extension, the section 55' of the microswitch housing 55 continues into an approximately cylindrically extending section 55".

A plug-in opening 58 for receiving the locking cylinder 1 extends from the front plate 55 of the microswitch housing 55. The diameter of the plug-in opening 58 corresponds to that of the locking cylinder housing 5. In order to permit the insertion of the locking cylinder housing 5, four grooves 59 which correspond in their width to the longitudinal ribs 6, 7, 8 and 9 extend distributed in rotational angle arrangement around the plug-in opening 58.

In the assembled position of the locking cylinder 1 the head end 14 of the locking cylinder housing 5 rests on the front plate 55, of the microswitch housing 55. In order that the locking cylinder 1 cannot be withdrawn by means of the key, a detent is provided between microswitch housing 55 and locking cylinder housing 5 in the manner that detent projections 60 of the microswitch housing 55 which protrude into the plug-in opening 58 engage in associated detent niches 61 of the locking cylinder housing 5. The detent projections 60 are so arranged that they permit the plugging-in of the locking cylinder 1 and in the process carry out an evasive movement in order to engage in the detent niches 61 after the plugging in movement is completed and secure the inserted position of the locking cylinder 1.

From FIG. 14 it can be noted that with the key withdrawn the end of a platelet tumbler 16 adjacent to the arm 19 engages through the window-shaped opening 21 and enters in form-fitting manner into the groove 59 of the microswitch housing 59. Corresponding twisting forces exerted on the cylinder core without use of the prescribed key result in the ends of the platelet-shaped tumblers 16 being able to rest against both the locking cylinder housing 5 and the microswitch housing 55, which leads to a more stable development and to increased unblocking security. Also during the back and forth movement of the platelet-shaped tumblers a resting of opposite ends of the platelet tumblers 16 can take place upon the application of torsional forces.

The manner of operation is as follows: If the locking cylinder 1 is to be locked with the first key 2, then the latter must first of all be introduced completely into the key channel 26. By the key 2 which passes through the windows 16' of the tumblers 16 or its locking notches 39 which act on the one transverse edge 16" of the window, the platelet tumblers are so aligned that their transverse edges 20 lie in the rotation joint of the cylinder core. Furthermore, the key 2 is supported on the narrow longitudinal edge 38 provided with the locking notches 39 by the support sections 40 and 42 which find support on the corresponding transverse flanks 41 and 43 of the key channel 26. In the inserted position, the stop edge 45 lies in the overlapping region between cylinder core 11 and locking cylinder housing 5, so that as a result of this nesting of one inside the other an extremely short structural length is obtained.

The locking rotation in the direction of the arrow can now b out. In the initial phase of the locking rotation, the non-spring-loaded additional pin 28 is moved away by the recess 31, its frustoconical end 28" entering into the entrance depression 44 of the key shaft 35, as shown by the dash-dot line representation of the additional pin 28 in FIG. 6. After a 90° rotation, the stop edge 45 of the key-shaft shoulder 37 strikes against the stop 50 on the head end 14 of the locking cylinder housing 5; see FIG. 9. In this position, the first key 2 can nevertheless not be withdrawn because there is no recess present for the additional pin 28 at the corresponding place on the locking cylinder housing 5. The cylinder core 11 can merely be turned back by means of the key 2 into the initial position shown in FIG. 8, which position permits the withdrawal of the key 2.

By means of the second key 3, the cylinder core 11 can be rotated 180° as a result of the more deeply notched stop edge 46. Upon reaching the 90° position of rotation, the edge 46 passes the stop 50 without difficulty and comes against the approximately radially directed stop 51 only after a 180° rotation; see FIG. 10. Also in this position it is not possible to withdraw the second key 3 out of the cylinder core 11 since no recess on the locking cylinder side lies opposite the additional pin 28. After rotating the cylinder core back by 180° the key 3 can then be withdrawn.

The locking cylinder 1 can then be locked by means of the third key 4. After its introduction into the key channel 26, the cylinder core 11 must be turned in clockwise direction. The stop edge 47 of the key 4 passes the stop 50 after a 90° angle of rotation. Upon reaching the 180° turned position the stop 51 is reached. Since the stop edge 47 lies slightly set back with respect to the latter, the cylinder core can be rotated a total of 270° until the stop edge 47 acts on the stop 52; see FIG. 11. Along with this, the stop projection 33 on the cylinder-core side also comes against the stop projection 34 of the locking cylinder housing. In this position of rotation, the non-spring-loaded additional pin 28 lies opposite the recess 31 of the cylinder housing so that the key 4 can be withdrawn. The turning back of the cylinder core 11 takes place in the opposite direction of rotation after introduction of the key 4.

Instead of the manner described, other locking positions can be obtained by the arrangement of additional stops and corresponding stop edges.

I claim:

1. A locking device having a key and locking cylinder suitable for actuation of electrical microswitches on keyboards, wherein the locking cylinder comprises a locking cylinder housing having a bore, and a cylinder bore which is arranged for rotation in said bore;

a plurality of stops disposed on said locking cylinder housing;

a plurality of platelet-shaped tumblers disposed in said cylinder core, the cylinder core having a head plate, the key having a stepped-down key shaft with a radially projecting shoulder and being insertable via said head plate into the cylinder core, said key coming after a specific rotation to rest against said stops of said locking cylinder housing;

and a free space is provided between said head plate of said cylinder core arranged on a front side of said locking cylinder and a head end of said locking cylinder housing, into which free space a key-shaft shoulder of the key can enter;

said plurality of stops of said locking cylinder housing are arranged at different distances from an axis of rotation of said cylinder core, at least one of said stops protruding for limiting an angle of rotation of said cylinder core by a striking upon the key-shaft shoulder;

said locking device further comprises a microswitch housing with grooves arranged along an interior surface of a wall of the microswitch housing facing said locking cylinder;

said locking cylinder housing has radially projecting longitudinally ribs which enter in form-locked manner into said grooves in the wall of said microswitch housing; and said locking cylinder housing has window-shaped openings arranged axially aligned with said longitudinal ribs for passage of ends of said platelet-shaped tumblers.

2. A locking device according to claim 1, wherein said head end of said locking cylinder housing forms said plurality of stops; and said plurality of stops is arranged overlapping said head plate, said head plate permitting passage of said key-shaft shoulder.

3. A locking device according to claim 1, wherein said key shaft is configured with a planar shaped and opposed first and second narrow longitudinal edges, said key shaft comprising a plurality of locking notches disposed on said first edge, and comprising on said second edge a step into the key-shaft shoulder.

4. A locking device according to claim 1, wherein said key comprises at least one profiled longitudinal groove cut into said key-shaft shoulder.

5. A locking device according to claim 1, further comprising a first stop projection disposed on said locking cylinder housing and a second stop projection disposed on said cylinder core head plate for limiting a range of rotation of said head plate relative to said cylinder housing.

6. A locking device according to claim 1, wherein said locking device is operable with said key and at least one additional key, said locking device further comprising a non-spring-loaded pin disposed in said cylinder core for prevention of withdrawal of one of said keys in specific positions of rotation associated with individual ones of said keys.

7. A locking device according to claim 1, wherein said key comprises support sections on a tip of the key and in a narrow longitudinal edge region opposite said key-shaft shoulder, said longitudinal edge region extending parallel to a direction of insertion of said key; and said cylinder bore defines a key channel having transverse flanks for engaging said support sections of said key.

8. A locking device according to claim 1, wherein a platelet tumbler has lateral frame arms for encircling said key, a cross section of each of said frame arms being characterized by a width and a thickness which are approximately equal.

9. A locking device according to claim 1, wherein there are four of said longitudinal ribs and four of said window-shaped openings arranged in equal angular distribution about a longitudinal axis of said locking cylinder.

10. A locking device according to claim 5, wherein a stop position of said first and said second stop projections lies in alignment with a position of angular rotation of one of said window-shaped openings;

wherein said locking device is operable with said key and at least one additional key, said locking device further comprises a non-spring-loaded pin disposed in said cylinder core and movable transversely of a rotational axis of said cylinder core for contacting the key upon insertion of the key in said cylinder core;

said cylinder housing has a plurality of entrance recesses disposed in a plane transverse to said rotation axis and coplanar with said non-spring-loaded pin for receiving said non-spring-loaded pin upon deflection of said non-spring-loaded pin by the key; and at least one entrance recess is located coplanar with one of said longitudinal ribs in a common longitudinal plane of said locking cylinder.

11. A locking device according to claim 7, wherein one of said transverse flanks of said key channel is located at said head plate for support of said key shaft shoulder.

* * * * *